US009949544B2

(12) United States Patent
Samain

(10) Patent No.: US 9,949,544 B2
(45) Date of Patent: Apr. 24, 2018

(54) METHOD FOR PRODUCING A SHADING ON THE HAIR

(71) Applicant: L'OREAL, Paris (FR)

(72) Inventor: Henri Samain, Bievres (FR)

(73) Assignee: L'OREAL, Paris (FR)

( * ) Notice: Subject to any disclaimer, the term of this patent is extended or adjusted under 35 U.S.C. 154(b) by 0 days.

(21) Appl. No.: 14/366,996

(22) PCT Filed: Dec. 18, 2012

(86) PCT No.: PCT/IB2012/057424
§ 371 (c)(1),
(2) Date: Jun. 19, 2014

(87) PCT Pub. No.: WO2013/093773
PCT Pub. Date: Jun. 27, 2013

(65) Prior Publication Data

US 2014/0366904 A1 Dec. 18, 2014

Related U.S. Application Data

(60) Provisional application No. 61/604,916, filed on Feb. 29, 2012.

(30) Foreign Application Priority Data

Dec. 20, 2011 (FR) ..... 11 62082

(51) Int. Cl.

| | |
|---|---|
| ***A45D 19/00*** | (2006.01) |
| ***A45D 19/02*** | (2006.01) |
| ***B65D 81/32*** | (2006.01) |
| ***B65D 47/26*** | (2006.01) |
| ***A45D 19/16*** | (2006.01) |

(52) U.S. Cl.
CPC ..... *A45D 19/0008* (2013.01); *A45D 19/02* (2013.01); *A45D 19/16* (2013.01); *B65D 47/265* (2013.01); *B65D 81/3283* (2013.01); *A45D 19/0016* (2013.01); *A45D 2019/0075* (2013.01); *A45D 2019/025* (2013.01); *A45D 2200/205* (2013.01)

(58) Field of Classification Search
None
See application file for complete search history.

(56) References Cited

U.S. PATENT DOCUMENTS

| | | | | |
|---|---|---|---|---|
| 5,860,431 | A | 1/1999 | Abercrombie et al. | |
| 5,913,315 | A | 6/1999 | Todd | |
| 2004/0093659 | A1* | 5/2004 | VeDepo | A42B 1/04 2/195.7 |
| 2005/0184091 | A1 | 8/2005 | Abergel | |
| 2006/0108247 | A1 | 5/2006 | Liechty et al. | |
| 2006/0134030 | A1* | 6/2006 | Molenda | A61K 8/34 424/59 |
| 2007/0215169 | A1 | 9/2007 | Daneshvar | |
| 2009/0220442 | A1* | 9/2009 | Brillouet | A61K 8/35 424/60 |
| 2010/0015079 | A1* | 1/2010 | Schrader | A61K 8/466 424/70.31 |
| 2011/0017227 | A1 | 1/2011 | Samain | |
| 2014/0352714 | A1 | 12/2014 | Samain | |
| 2014/0366904 | A1 | 12/2014 | Samain | |

FOREIGN PATENT DOCUMENTS

| | | | |
|---|---|---|---|
| EP | 0 251 968 | A2 | 1/1988 |
| EP | 1 557 110 | A1 | 7/2005 |
| EP | 1 656 853 | A1 | 5/2006 |
| GB | 2 234 758 | A | 2/1991 |
| JP | 1-311012 | | 12/1989 |
| JP | 2002-47152 | | 2/2002 |
| JP | 2003-26555 | A | 1/2003 |
| JP | 2004-4149417 | A | 5/2004 |
| WO | 03/041531 | A1 | 5/2003 |
| WO | 2009/074957 | | 6/2009 |
| WO | 2013/093775 | A1 | 6/2013 |

OTHER PUBLICATIONS

International Search Report and the Written Opinion for International Application No. PCT/IB2012/057429 dated Mar. 14, 2013.
Preliminary Search Report and Written Opinion for French Application No. 1161997 dated Aug. 17, 2012, with machine-generated English translation.
International Search Report and the Written Opinion of the International Searching Authority, International Application No. PCT/IB2012/057424 dated Mar. 7, 2013.
Preliminary Search Report and Written Opinion for French Application No. 1162082 dated Oct. 3, 2012.
Office Action issued in Japanese Application No. 2014-548295 dated Dec. 5, 2016 (with Machine Translation).
Office Action issued in related Japanese Application No. 2014-548296 dated Oct. 31, 2016 (with Machine Translation).
https://www.youtube.com/watch?v=MnW6PfVXVho, Highlight-Professional Stylist Tutorial Ombre Finish, YouTube, May 2, 2014.

* cited by examiner

*Primary Examiner* — Jyothsna A Venkat
(74) *Attorney, Agent, or Firm* — Jones Robb, PLLC

(57) ABSTRACT

Method for producing a shading on the hair, comprising the stage consisting in:

subjecting an amount of a composition (100) capable of exhibiting a variation in its hair dyeing or bleaching power under the effect of a chemical and/or energy stimulus to the said stimulus, so as to obtain at least two fractions (1000; 2000) of the said amount each having a hair dyeing or bleaching power distinct from that of the other fraction, the composition (100) being subjected to the stimulus before or after it is brought into contact with the hair and the composition producing, after exposure to the said stimulus and being brought into contact with the hair, a shaded dyeing or bleaching.

14 Claims, 9 Drawing Sheets

METHOD FOR PRODUCING A SHADING ON THE HAIR

This is a national stage application of PCT/IB2012/057424, filed internationally on Dec. 18, 2012, which claims priority to French Application No. FR 1162082, filed Dec. 20, 2011, and to U.S. Provisional Application No. 61/604,916, filed Feb. 29, 2012.

The present invention relates to the field of hair dyeing and more particularly to the production of shadings on the hair.

BACKGROUND

The techniques conventionally used in the field of the dyeing or bleaching of the hair are targeted at obtaining uniform colours or at obtaining locks having a different colour from the remainder of the hair.

Trials have been carried out in order to create areas of non-uniformity in the hair by applying, along one and the same lock, one colour and then another, for example, a blonde colouration on the first half of the lock and a brown colouration on the second half. The results obtained on conclusion of these trials can be regarded as unattractive and in general comparable to a colouration obtained after regrowth of the hair.

In some cases, as the hair is sensitized, a dyeing treatment can give non-uniform results which may be regarded as unattractive as being marked by abrupt transitions from one colour to another.

Furthermore, it is known to treat locks in order to confer, on the hair, an appearance similar to that produced by exposure to the sun. The hairdresser then isolates a few locks and applies a bleaching agent to them.

In the case of light hair (blonde or dark blonde hair, for example), a result is obtained which may be regarded as relatively attractive but is often judged to be rather unnatural.

The attractive nature comes from the fact that each bleached lock opens out towards the ends and thus the light hairs are lost somewhat among the other hairs of the ends. By this opening-out effect, the two colours do not contrast with one another to any great extent.

The rather unnatural character comes from the roots. This is because, on approaching the roots, the hairs of the locks become closer with respect to one another, thus producing an effect of bundles which is rather unnatural as a result of a contrast in colours.

Thus, the locks may give a relatively natural appearance at the ends and at mid-length, while the roots may produce an artificial appearance.

In order to reduce the artificial appearance of the roots, it might be envisaged to decrease the lightening of the hairs of the treated locks. However, such a solution, which reduces the visibility of the lightening, might prove not to be satisfactory. This is because, in order to produce reasonably visible locks, it may be necessary to lighten by approximately 4 tones, such a difference rendering the roots rather unnatural.

Another approach consists in isolating and treating very fine locks. However, this approach is expensive as a result of the time spent by the hairdresser and does not really solve the problem of the visibility of the roots.

Another approach consists in producing the locks starting from the scalp. However, this approach can result in excessive lightening.

There also exists a need to obtain a method for producing dyed or bleached locks which are thicker and more attractive in order to limit the time spent and to render the service less expensive.

There exists a need to produce locks on dark heads of hair (light chestnut, chestnut, dark chestnut or brown), in particular in order to be able to treat heads of brown hair without having to lighten them beforehand.

The invention is targeted at meeting all or part of the abovementioned needs.

SUMMARY

According to a first of its aspects, the present invention relates to a method for producing a shading on the hair, comprising the stage consisting in:

subjecting an amount of a composition capable of exhibiting a variation in its hair dyeing or bleaching power under the effect of a chemical and/or energy stimulus to the said stimulus, so as to obtain at least two fractions of the said amount each having a hair dyeing or bleaching power distinct from that of the other fraction, the composition being subjected to the stimulus before or after it is brought into contact with the hair and the composition producing, after submitting to the said stimulus and being brought into contact with the hair, a shaded dyeing or bleaching.

The term "shaded dyeing or bleaching" should be understood as meaning a dyeing or bleaching of the hair delimited by at least two distinct zones of colours, it being possible for the hair thus dyed or bleached to have one or more colorimetric coordinates chosen from L, C*, h, a and b which vary continuously between these two zones.

It is thus possible to obtain a shaded dyeing or bleaching such that, between the two distinct zones of colours, the dyed or bleached hair exhibits a hue h which varies continuously.

It is also possible to obtain a shaded dyeing or bleaching such that, between the two distinct zones of colours, the dyed or bleached hair exhibits a lightness L* which varies continuously.

More particularly, shadings on the hair ranging:

from light or dark or vice versa according to one and the same tone, from one tone to another with an equivalent lightness, or one of their combinations, can be regarded as particularly attractive.

As described in detail below, the variation in the colorimetric coordinate between the two zones may or may not be even.

The invention makes it possible to obtain shaded dyeing or bleaching of the hair, in particular of the locks, by creating, for example, a bleaching which starts from 2 tones at the roots up to 4 tones or more towards the ends.

For the record, the tones measure the lightness of the hair on a scale from 1 to 10, the value 1 corresponding to black and the value 10 to platinum blonde. The values 3, 5 and 7 respectively correspond to brown, chestnut and dark blonde.

The shading can be obtained by a gradual bleaching of the hair, when the progression is towards the root or towards the end, the composition being a bleaching composition.

Each fraction of composition above can correspond, in the case where the composition extends along an axis, to a certain region along this axis, the dimension of which is, for example, very low, if the composition continuously changes in formulation due to the application of the stimulus according to a continuous gradient.

Throughout the continuation, unless otherwise indicated, "composition" will denote the composition according to the invention capable of exhibiting a variation in its hair dyeing or bleaching power under the effect of the chemical and/or energy stimulus.

The shaded dyeing or bleaching can be carried out over all or part of the length of one or more lock(s) of hair. The shaded dyeing or bleaching can consequently be carried out on one or more lock(s) of hair from the root to the end of the hairs treated.

Preferably, the shading extends as far as the root, even if the shadings obtained by the methods according to the invention can start at a point which is not necessarily the root and can terminate at another point which is not the end.

This shadings can be produced over all or part of the head of hair and in particular on one or more locks The use according to the invention of a composition sensitive to a stimulus and of this stimulus makes it easier to obtain variable dyeing or bleaching properties, in particular properties which vary gradually, which is suitable for the production of a shading.

It is possible to produce shadings having different appearances according to the point of the head of hair and/or according to the composition chosen.

The stimulus can be luminous, thermal, mechanical and/or chemical, in particular pH or redox.

The stimulus can be applied by a device for application of the stimulus comprising a luminous irradiator and/or a heating member and/or a reservoir intended to contain the composition. The stimulus may or may not be applied in situ.

The device for application of the stimulus is, for example, in the form of a handpiece or comprises a handpiece. In this case, the user can move the handpiece relative to the composition and can thus expose the latter to the stimulus to a greater or lesser degree according to the location, so as to locally modify its dyeing or bleaching properties.

The method can in particular comprise the stage consisting in differently exposing the composition to the stimulus according to the location, preferably so as to create a gradual variation in its properties.

Independently of or in combination with the above, the present invention relates, according to another of its aspects, to a cosmetic assembly, in particular for the implementation of the method according to the invention as defined above, comprising:

- a composition capable of exhibiting a variation in its hair dyeing or bleaching power under the effect of a chemical and/or energy stimulus, and
- a device for application of the stimulus, configured in order to apply the said chemical and/or energy stimulus, the said device for application of the stimulus comprising, for example, a system for guiding the hair and being, in this case, preferably also in the form of a handpiece.

Independently of or in combination with the above, the present invention further relates, according to another of its aspects, to a cosmetic assembly, in particular for the implementation of the method according to the invention as defined above, comprising:

- a composition capable of exhibiting a variation in its hair dyeing or bleaching power under the effect of a chemical and/or energy stimulus,
- an application element, in particular a sheet element, on which the said composition is intended to be applied, and
- a product comprising a developer or inhibitor, in particular an oxidizing or reducing agent.

According to this aspect of the invention, the composition is present on the sheet element before being brought into contact with the head of hair and the sheet element is left in place during the action of the composition. The sheet element can, in this case, act as a protective means which reduces the risk of transfer onto the other hairs by forming a barrier between the treated hairs and the other hairs.

Independently of or in combination with the above, the present invention thus relates, according to another of its aspects, to a sheet element comprising, in a first zone, a deposit of a composition capable of exhibiting a variation in its hair dyeing or bleaching power under the effect of a chemical and/or energy stimulus and, in a second zone, a deposit of a product comprising a developer or inhibitor.

The sheet element can be configured in order to allow the first and second zones to come into complete or partial contact, for example by folding back over itself.

Before being brought into contact with the developer or inhibitor, the weight per unit of surface area of the composition can vary according to the position within the first zone. This weight per unit of surface area can vary in a strictly monotonal manner on moving along a longitudinal axis of the first zone. In an alternative form, the weight per unit of surface area of the composition can be substantially constant on moving along the longitudinal axis of the first zone.

Before being brought into contact with the composition, the amount of material per unit of surface area of the said developer or inhibitor can vary according to the position within the second zone. This amount of material per unit of surface area can vary in a strictly monotonal manner on moving along the longitudinal axis of the said second zone. In an alternative form, this amount of material per unit of surface area can be substantially constant on moving along the longitudinal axis of the said second zone.

The operation in which the composition and the product comprising the developer or inhibitor are brought into contact results in a mixture, the dyeing or bleaching properties of which vary along the longitudinal axis of the sheet element, which makes it possible to obtain a shaded dyeing or bleaching.

Independently of or in combination with the above, the present invention also relates, according to another of its aspects, to an application element, in particular a sheet element, comprising, in a first zone, a deposit of the said composition, the weight per unit of surface area of the said composition being constant or varying according to the position in the said first zone. This weight per unit of surface area can vary in a strictly monotonal manner on moving along the longitudinal axis of the said first zone.

Such an application element can be incorporated within a cosmetic assembly additionally comprising a product comprising a developer or inhibitor.

Independently of or in combination with the above, the present invention relates, according to another of its aspects, to an application element, in particular a sheet element, comprising, in a second zone, a deposit of a product comprising a developer or inhibitor, the amount of material per unit of surface area of developer or inhibitor being substantially constant or varying according to the position in the said second zone. This amount of material per unit of surface area can vary in a strictly monotonal manner on moving along the longitudinal axis of the said second zone.

Such an application element can be incorporated within a cosmetic assembly additionally comprising the said composition.

It is possible for the said composition and/or the developer or inhibitor to be present in an inactivated form.

The method can then comprise a stage of activation of the said composition and/or the developer or inhibitor, for example by subjecting them to a luminous, thermal, chemical and/or mechanical stimulus.

For example, the composition is deposited on a sheet element and comprises an alkaline agent, aqueous hydrogen peroxide solution and a powder of a persalt encapsulated in a wax, the melting point of which varies from 40 to 60° C.

The application of a temperature gradient at the sheet element can make it possible to release to a greater or lesser extent the persalt encapsulated in the wax and to obtain a deposit having a gradual hair bleaching power, so as to obtain a shading.

Stimulus

The term "to subject the composition to a non-zero gradient of a stimulus" should be understood as meaning that the composition, deposited on the hair or on another support, in particular an application element, or prior to the dispensing thereof by a device, or during this dispensing, is subjected to a variation, along at least one direction, of a quantity characterizing the stimulus.

The composition can be subjected in its entirety, at one and the same moment, to a spatially non-uniform stimulus, so that some regions of the mass of composition are more exposed than others to the stimulus, thereby causing the dyeing or bleaching properties of the composition to vary.

The composition can also be subjected to a stimulus which varies over time according to the zones exposed and/or which subjects certain zones to the stimulus for a longer time than others. In this case, the mass of composition receives over time an exposure to the stimulus which varies according to its zones.

The shaded dyeing or bleaching obtained in the context of the methods according to the invention can be produced as a result of subjecting the composition to a non-zero gradient of a stimulus.

In this case, the shaded dyeing or bleaching can be obtained by imposing a non-zero gradient of a stimulus on a composition deposit exhibiting an amount of deposited composition which is constant on moving along the said deposit. Thus, it is possible to impose a different temperature according to the zone of the deposit under consideration.

It is also possible to obtain the shaded dyeing or bleaching by imposing a non-zero gradient of a stimulus or a spatially uniform stimulus on a composition deposit exhibiting an amount of deposited composition which can vary on moving along the said deposit. Thus, the shaded dyeing or bleaching obtained is, in one embodiment, produced as a result of the variation in the amount of composition deposited along the said deposit.

Luminous and/or Thermal Stimulus

In an implementational example, the composition is subjected to a non-zero temperature gradient.

In this case, a first zone of a composition deposit can be brought to a first temperature while a second zone, separate from the first, can be brought to a second temperature different from the first.

The composition is then chosen in order to exhibit dyeing or bleaching properties which vary according to the temperature, due, for example, to the use of a compound encapsulated in a wax or due to a modification to the reaction kinetics.

As described in detail subsequently, the composition can initially be present in a reservoir of the device for application of the stimulus, which ensures the dispensing thereof, for example over the hair. In an implementational example, the device for application of the stimulus can bring a first part of the composition to a first temperature in a first zone in order to obtain the said first fraction, which will be dispensed over the hair. The device for application of the stimulus can subsequently carry out a relative movement with respect to the treated hair and can then bring a second part of the composition to a second temperature, different from the first, in a second zone of the hair, separate from the first, in order to obtain the said second fraction and then ensure the dispensing thereof over the hair.

The non-zero temperature gradient can, in particular, be generated by application of infrared radiation or by bringing into contact with a heating surface having a non-uniform temperature.

The temperature gradient is obtained, for example, by having infrared radiation sources which are more numerous or more powerful at one point than at another.

In the case of a heating surface, the heat is, for example, released by at least one resistive element through which an electric current passes, with a non-uniform distribution of this resistive element.

The first fraction can also be obtained by subjecting the composition to a first radiation having a first dominant wavelength and the second fraction can be obtained by subjecting the composition to a second radiation having a second dominant wavelength different from the first. These different wavelengths can induce one or more differentiated reactions within the composition, for example can catalyse a reaction to a greater or lesser extent, and can thus cause dyeing or bleaching properties which will vary.

The first fraction can be obtained by subjecting the composition to a first radiation during a first exposure time and the second fraction can be obtained by subjecting the composition to a second radiation during a second exposure time different from the first. In this case, the spectra of the first and second radiations can be different or identical.

The first fraction can be obtained by subjecting the composition to a first radiation during a first energy flux and the second fraction can be obtained by subjecting the composition to a second radiation during a second energy flux different from the first.

The first fraction can be obtained by subjecting the composition to first radiation having an energy spectral density curve having a first full width at half maximum for a given wavelength and the second fraction can be obtained by subjecting the composition to second radiation having an energy spectral density curve having a second full width at half maximum for this wavelength, the second full width at half maximum being different from the first.

The luminous and/or thermal stimulus can, for example, comprise ultraviolet radiation. In this case, the composition can be a photochromic composition, in particular having an irreversible colour change.

Chemical Stimulus

The stimulus can be chemical and the said at least two fractions can be produced by bringing the said composition into contact with a developer or inhibitor, in particular an oxidizing agent or reducing agent, so that the said composition is subjected to a non-zero gradient of amount of material of and/or time of exposure to developer or inhibitor. Thus, it is possible to obtain a mass of composition having bleaching or dyeing properties which vary spatially.

When it is desired to carry out an oxidation dyeing, the developer can be an alkaline agent or a metal catalyst and the inhibitor can be an acid agent, a complexing agent, an agent for dismutation of the developer or a reducing agent.

The oxidizing agent can be hydrogen peroxide, an organic peroxide, such as benzoyl peroxide, a peracid, such as peracetic acid, a halogen oxide, a persalt agent, such as persilicate or perborate, or a peroxide metal salt, such as potassium permanganate.

The developer or inhibitor can make it possible to vary the pH of the composition. Specifically, a pH rise can make it possible to increase the bleaching power and a pH fall can make it possible to decrease the bleaching power.

The developer or inhibitor can comprise a hair sensitizing or desensitizing agent, in particular a thiol.

In this case, the method can comprise the stages consisting in:

applying a sensitizing or desensitizing agent along a lock of hair, so that the amount of material of the said agent, applied per unit of surface area, varies when moving along the said lock of hair, and applying the composition to the said lock, thus sensitized or desensitized, it being possible for the weight of composition applied per unit of surface area to vary or to be constant when moving along the lock.

Along the lock, the sensitizing or desensitizing agent can be applied with an amount which varies in volume but which is unchanging in concentration or, in an alternative form, with an amount which is unchanging in volume and with a variable concentration, or both.

Mechanical Stimulus

In this case, the method according to the invention can comprise the stages consisting in:

applying the said composition to the hair or to a support, and imposing, on the said composition, a mechanical constraint in order to obtain the shaded dyeing or bleaching.

In the case of the application of the composition to a support, the composition is subsequently transferred onto the hair.

The mechanical constraint can be applied in a spatially non-uniform manner in a deposit of the said composition in order to obtain the first and second fractions. The mechanical constraint has, for example, a variable intensity according to the location of the deposit.

It is possible to employ a support initially comprising a dyeing or bleaching agent present in pressure-sensitive capsules.

In an alternative form, use is made of a support initially comprising a dyeing or bleaching agent and capsules comprising a pressure-sensitive accelerator or inhibitor, such as an alkaline agent, a complexing agent, a reducing agent, an acidifying agent or a catalyst.

In the two last cases, a mechanical constraint of variable intensity according to the position on the deposit can be imposed in order to burst more or fewer capsules and to thus obtain the desired shaded dyeing or bleaching power for the hair.

Device for Application of the Stimulus

The device for application of the stimulus can comprise a system for guiding the hair and/or for positioning in relation to the head of the user.

The guiding system can in particular be in the form of a clip.

The method according to the invention can comprise a stage of determination of the positioning of the device for application of the stimulus in relation to a surface on which the composition is intended to be applied or is applied. This facilitates the application of the stimulus which is locally suitable for producing the desired dyeing or bleaching.

This surface can be defined by the hair on which the shading of dyeing or bleaching will be carried out or by an application element.

The positioning of the device for application of the stimulus in relation to the surface can be determined in various ways.

In the case where the composition is present on a support other than the hair, and then subsequently transferred onto the hair, the support can, for example, be moved in a controlled way, in relation to a source for application of the stimulus, the position of the support in relation to the source for application of the stimulus being known all the time by the device, so as to locally apply the stimulus which is appropriate.

When the composition is already present on the hair during the application of the stimulus, the device can, for example, pinpoint its position along the hair, starting from the root or from the end.

In order to determine the position in the space of the device for application of the stimulus, use may be made of an accelerometer. The position in the space can be deduced by double integration.

The device for application of the stimulus can be sensitive, in an implementational example of the invention, to its displacement in relation to the hair, which can allow it, knowing a reference point situated, for example, at the root of the hair, to know the positioning thereof along the hair, this information being useful for modifying the stimulus applied in order to obtain the desired dyeing or bleaching.

The device for application of the stimulus can comprise a device which makes it possible, before starting or during the operation for application of the stimulus, to initialize or re-initialize the means used to detect the positioning of the application device.

Independently of or in combination with the above, the device for application of the stimulus can be in the form of a handpiece.

The term "handpiece" denotes a piece handled by the user with a hand during the implementation of the method according to the invention.

The handpiece may comprise a grasping part and may or may not be connected to a base unit.

The method can comprise the successive stages consisting in:

introducing a first lock of hair into the guiding system of the device for application of the stimulus, carrying out a shaded dyeing or bleaching on the said first lock by implementing a method as described above, optionally applying, over all or part of the shaded dyeing or bleaching carried out on the said first lock, a protective means which makes it possible to mechanically protect the said shaded dyeing or bleaching with regard to an undesired transfer, for example onto other hair, then disengaging the said first lock of hair from the guiding system and introducing therein a second lock of hair, carrying out a shaded dyeing or bleaching on the said second lock by employing a method according to the invention.

In an alternative form, the method according to the invention can make it possible to carry out a simultaneous treatment of a plurality of locks of hair.

Thus, the method can comprise the stages consisting in:

simultaneously carrying out, on a plurality of locks of hair, a shaded dyeing or bleaching by implementing a method as described above, and optionally applying, to all or part of the shaded dyeings or bleachings carried out, a protective means which makes it possible to mechanically protect them.

It is possible, in this case, to use a device for application of the stimulus comprising a comb defining a plurality of treatment spaces within which the locks to be treated are intended to be inserted. This comb exhibits, for example, a shape suited to the curvature of the skull, so as to facilitate the insertion of the locks inside, from the root.

Such a method can consequently comprise, before carrying out the shaded dyeing or bleaching, a stage of positioning in the system for guiding the locks of hair to be treated.

The device for application of the stimulus can furthermore be moved along the locks to be treated as the shaded dyeings or bleachings are carried out, for example being integral with the abovementioned application device.

Protective means which can be used in the context of the present invention will be described subsequently.

Order in which the Stages of Application of the Stimulus and of Bringing the Composition into Contact with the Hair are Carried Out Before Bringing the Composition into Contact with the Hair The exposure to the stimulus can take place before bringing the composition into contact with the hair.

In this case, the composition can, during the submission to the stimulus, be present on an application element, it being possible for the said application element to be in particular in the form of a sheet element.

The composition can, for example, be deposited on an application element, in particular a sheet element, and can be subjected to a non-zero temperature gradient in order to obtain two fractions with different properties, for example a gradual variation in its dyeing or bleaching properties.

The non-zero temperature gradient can be obtained by a heating means present within the application element or by bringing together a heating member and the deposit of the composition, the said heating member not being connected to the application element.

As mentioned above, the composition can be deposited on an application element, in particular a sheet element, in a first zone of the latter. A stage of bringing a developer or inhibitor into contact with the said composition can be carried out in order to obtain the first and second fractions.

In an alternative form, as mentioned above, the developer or inhibitor can be deposited in a second zone of an application element, in particular of a sheet element. A stage of bringing the developer or inhibitor into contact with the said composition can subsequently be carried out in order to obtain the first and second fractions.

In an alternative form, a deposit of composition can be present in a first zone of a sheet element and a deposit of developer or inhibitor can be present in a second zone of the said sheet element. The first and second zones can be brought into contact over all or part of their surface by folding the sheet element back over itself.

In this case, the weight per unit of surface area of composition can vary according to the position in the said first zone and the amount of developer or inhibitor material can be substantially constant or can vary according to the position in the said second zone.

In another implementational example, the weight per unit of surface area of composition is substantially constant according to the position in the said first zone and the amount of developer or inhibitor material per unit of surface area varies according to the position in the said second zone.

In another implementational example, the weight per unit of surface area of the said composition is substantially constant according to the position in the said first zone and the amount of developer or inhibitor material per unit of surface area can be substantially constant according to the position in the said second zone. In this case, the first and second fractions can be obtained by the varying the time for bringing the composition into contact with the developer or inhibitor.

On conclusion of the exposure to the stimulus, the composition, present on the application element, can exhibit a shaded hair dyeing or bleaching power.

The method according to the invention can subsequently comprise a stage in which such a composition is brought into contact with the hair, for example by transfer, in order to obtain the shaded dyeing or bleaching.

In an alternative form, the composition, initially present in the reservoir of the device for application of the stimulus, can be subjected to the stimulus before or during the dispensing thereof.

In this case, when the device for application of the stimulus is present in a first zone of a substrate, the latter can, before or during the dispensing of the composition, subject at least a fraction of the composition to the stimulus in order to obtain the first fraction.

The composition can, for example, be present in an applicator end piece of the device for application of the stimulus during the application of the said stimulus. The stimulus is, in this case, applied during the dispensing of the composition. In this case, a heating member and/or an irradiator, in particular a UV irradiator, can be present in the said applicator end piece.

In an alternative form, the stimulus can be applied while the composition is present in the reservoir in order to obtain the first fraction, which can subsequently be dispensed. In this case, the device for application of the stimulus can comprise an irradiator, in particular a UV irradiator, or a heating member capable of subjecting the composition present in the reservoir to the said stimulus.

In an alternative form, in particular when the stimulus is chemical, the device for application of the stimulus can comprise a first reservoir and a second reservoir respectively comprising the composition and a developer or inhibitor.

In this case, during the application to the hair or to an application element, the relative proportion of developer or inhibitor and of composition dispensed can be modified while the device for application of the stimulus is moved in relation to the substrate.

In an implementational example, the mixing between the composition and the developer or inhibitor can take place while the composition is still present in the first reservoir and, in this case, the device for application of the stimulus can comprise a channel joining the first reservoir and the second reservoir.

In an alternative form, the mixing between the composition and the developer or inhibitor is carried out while the composition is no longer present in the first reservoir but before the composition has been dispensed.

Mixing members, such as beads or paddles, can be present in the first reservoir and the second reservoir, if appropriate.

After Bringing the Composition into Contact with the Hair

The method according to the invention can comprise, before subjecting to the stimulus, a stage in which the composition is brought into contact with the hair.

The composition can, for example, be deposited on one or more locks of hair.

In this case, the device for application of the stimulus can comprise a system for guiding the hair.

The method according to the invention can comprise the stages consisting in:

introducing a first lock of hair into the guiding system of the device for application of the stimulus, moving the device for application of the stimulus in relation to the lock of hair introduced, a variation in the stimulus, for example in the temperature along the lock or the intensity of exposure to a radiation, being imposed on the composition in order to obtain the shaded dyeing or bleaching.

In an alternative form, the stage of moving the device for application of the stimulus can be accompanied by the dispensing of a developer or inhibitor, this dispensing taking place in a variable amount and/or with a variable concentration according to the position of the device for application of the stimulus along the treated lock of hair.

Shaded Dyeing Obtained

The shaded dyeing or bleaching of the hair obtained can comprise a first region and a second region exhibiting between them a colour difference ΔE in the CIELab space of greater than or equal to 1, in particular of greater than or equal to 3.

Change in the Colour Between the Root and the Ends

At least one colorimetric coordinate chosen from L, C*, a, b and h may change continuously, in particular linearly, when moving along a lock of hair treated by a method according to the invention.

In an implementational example, at least one of these colorimetric coordinates can change in an asymptotic manner, that is to say that, on moving along a lock of hair treated by a method according to the invention towards a given abscissa, the said colorimetric coordinate varies less and less per unit of distance. In other words, on moving along a lock of hair treated by a method according to the invention towards a given abscissa, the derivative of the said colorimetric coordinate with respect to the position along the lock is decreasing.

For example, in the last three centimeters before the said abscissa, the said colorimetric coordinate varies by no more than 30% of that which it varied in the three centimeters of a portion 6 centimeters away from said abscissa (between 9 and 6 cm from the said abscissa).

The said abscissa can be located in at least one of the following regions:

the zone of the shading closest to the root of the hair, the zone of the shading closest to the end of the hair, or a central zone.

The production of an asymptotic shading on the treated hair is preferred for aesthetic reasons. Preferably, an asymptotic shading is produced with a colorimetric coordinate which varies less and less per unit of distance when moving towards a zone of the shading close to the root of the hair.

The shadings may or may not be adapted to the length of the lock according to the points on the head of hair.

Thus, the shading obtained on a first lock can, for example, correspond, to within about one homothetic transformation, to the shading obtained on a second lock having a different length from the first lock. The homothetic ratio can, in this case, correspond to the ratio of the length of the first lock divided by the length of the second lock.

In an alternative form, it is possible to obtain two identical shadings on two locks of hair having different lengths.

Application Element

The application element can comprise, in particular can consist of, a sheet element.

In an alternative form, the application element can comprise a container comprising a housing intended to receive the composition capable of exhibiting a variation in its hair dyeing or bleaching power under the effect of a chemical and/or energy stimulus.

The application element can comprise, on a surface intended to come into contact with the hair, at least two composition fractions exhibiting distinct hair dyeing or bleaching powers.

These two fractions can be in a congealed form, in particular in the form of a gel.

The sheet element can comprise, in particular can consist of, a thermoplastic, a paper or a metal, in particular aluminium.

The sheet element can comprise, in particular can consist of, a water-soluble material.

In a preferred alternative form, the sheet element comprises an assemblage of a layer of a water-soluble material and of a layer of a water-insoluble material.

The method according to the invention can comprise the stage consisting in winding a sheet element as described above around a lock of hair.

Protective Means

A protective means can be applied to all or part of the shaded dyeing or bleaching obtained.

The protective means can, for example, be in the form of a pulverulent composition, in particular a fibrous pulverulent composition.

The average size of the particles making up the pulverulent composition can be between 1 μm and 3 mm, preferably between 5 and 500 μm.

The term "average size" denotes the statistical particle size dimension at half the population, referred to as D (0.5).

The protective means can be in the form of a sheet element, which can be impermeable to air.

The sheet element can comprise, in particular can consist of, a plastic, in particular a thermoplastic, a paper, a metal, in particular aluminium, a woven material or a non-woven material made of cellulose or one of its derivatives or polyamide 6,6.

The protective means can come into contact with the composition deposit produced.

The protective means can be immiscible with the composition on which it is applied.

The protective means can be applied to a plurality of locks of hair, each covered with a shaded dyeing or bleaching.

The protective means can be applied manually. All or part of the hair carrying the shaded dyeing or bleaching can be enveloped by a sheet element.

In an alternative form, the protective means can be applied using an applicator, in particular of the device for application of the stimulus, the latter comprising in particular a system for guiding the hair and/or dispensing the composition intended to be covered by the said protective means.

The protective means can define, once applied to the composition, an external casing extending in all or part around the lock to which it is applied, the said protective means defining in particular a tubular sheath in which the lock is present.

The protective means can be removed by rinsing, washing, rubbing and/or using a hair dryer.

DESCRIPTION OF THE FIGURES

The invention can be better understood on reading the detailed description which will follow of non-limiting implementational examples thereof and on examining the appended drawings, in which:

FIG. 1 diagrammatically illustrates the production, on a head of hair C, of locks 700 having a uniform colour by the implementation of methods known from the state of the art. Such locks 700 may, as explained below, exhibit a rather unnatural appearance at the roots 702.

As illustrated, this variation can be linear according to the position along the lock (solid-line curves) or non-linear, in particular asymptotic (broken-line curves).

It is possible to obtain, along a lock treated by a method according to the invention, a linear or asymptotic variation in L (lightness) on moving along the lock from the root towards the end of the hairs.

It is also possible to obtain, along a lock treated by a method according to the invention, an in particular linear or asymptotic variation in C* (saturation) on moving along the lock from the root towards the end of the hairs.

It is furthermore possible to obtain, along a lock treated by a method according to the invention, an in particular linear or asymptotic variation in a (position on the red/green axis), on moving along the lock from the root towards the end of the hairs, or in b (position on the blue/yellow axis) or in h (hue).

One or more of the colorimetric characteristics chosen from L, C*, h, a and b can vary on moving along the treated lock of hair.

It is possible to obtain a dyeing, along a lock, which varies in "tones", the hairs gaining, for example, at least one bleaching tone.

Figure 1:
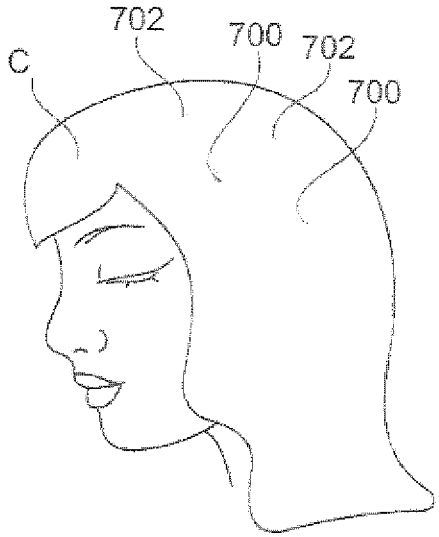
FIG. 1 diagrammatically represents the achievement of a dyeing known from the state of the art, FIG. 2 diagrammatically represents the achievement of a shaded dyeing according to the invention, FIGS. 3A and 3B diagrammatically illustrate the variation in colorimetric characteristics within shadings according to the invention, FIGS. 4A and 4B diagrammatically illustrate the variation in the stimuli applied in order to obtain the shadings according to the invention, FIGS. 5A and 5B diagrammatically represent various types of shaded colourings obtained by implementing a method according to the invention, FIG. 6 diagrammatically and partially represents the use of a device for application of the stimulus according to the invention.
Figure 2:
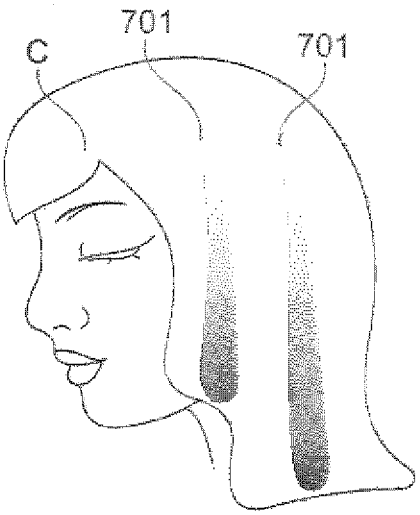
FIG. 2 diagrammatically illustrates the production, on the head of hair C, of shaded locks 701, for example where the hue varies along the said locks 701. Such locks 701 are obtained by the implementation of methods according to the invention.
Figure 3A:
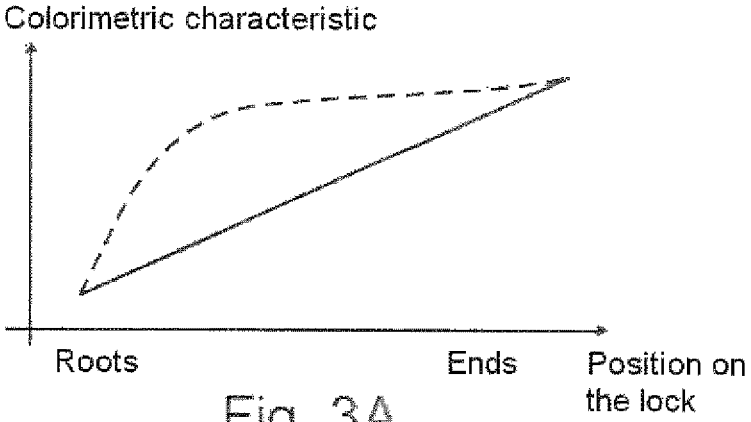
FIGS. 3A and 3B illustrate the variation in colorimetric characteristics along a lock carrying a shading according to the invention.
Figure 3B:
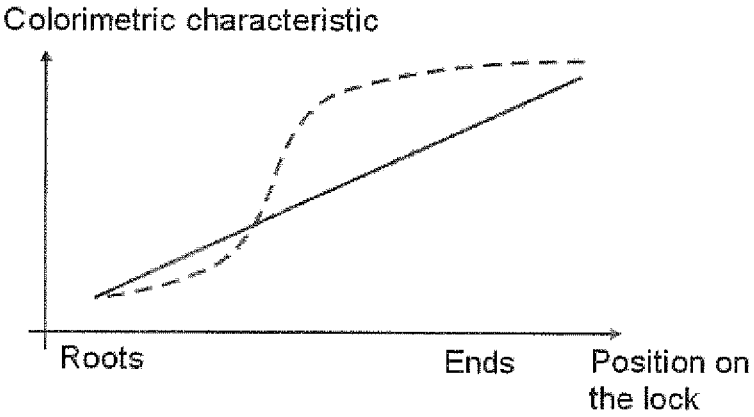

In the case where it is desired to treat half or more of the hairs, the shading can advantageously follow a sigmoid variation (dashed-line curve in FIG. 3B).

The variation in the colorimetric characteristic of such a shading is concentrated in the mid-zone of the length of the hairs and can make it possible to avoid the effects of roots and ends.

It is possible, for example, to obtain a colour at the roots which is relatively close to the colour visible at the roots before the method according to the invention is implemented. In particular, it is possible to obtain a colour at the roots which is nuanced, in particular lightened, by 2 tones with respect to the colour visible at the roots before the method according to the invention is implemented.

It is possible, for example, to obtain a colour at the ends which is significantly different from the colour visible at the ends before the method according to the invention is implemented. In particular, it is possible to obtain a colour at the ends which is nuanced, in particular lightened, by 4 tones or more with respect to the colour visible at the ends before the method according to the invention is implemented.

Figure 4A:
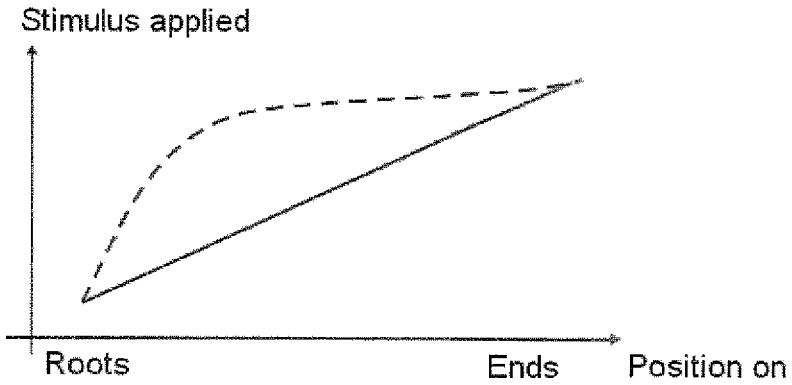
Figure 4B:
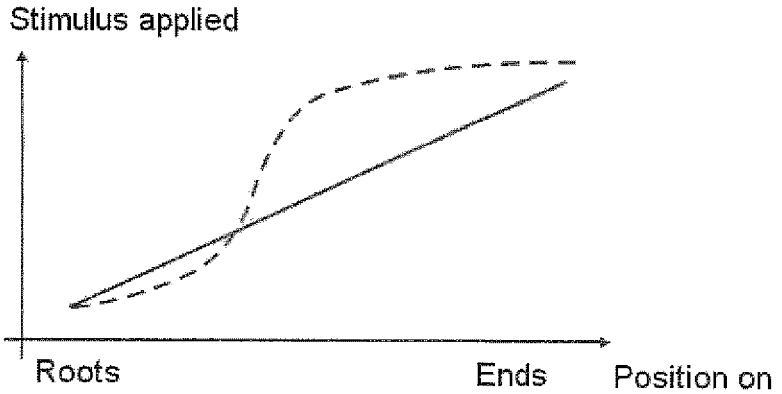
Figure 5A:
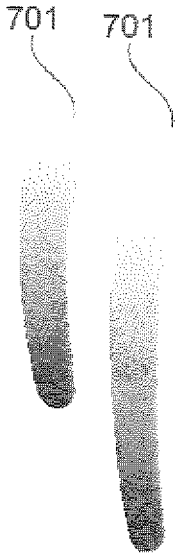
FIGS. 5A and 5B respectively illustrate colour shadings adapted to the length of the locks 701 and shadings which are identical whatever the length of the locks 701. The shadings obtained in FIG. 5A correspond to within about one homothetic transformation.
Figure 5B:
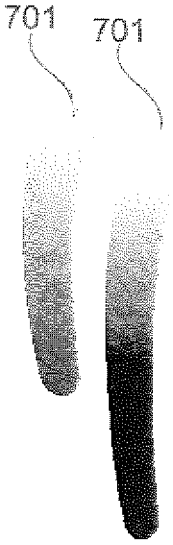

FIGS. 4A and 4B represent examples of change in the stimuli applied along the lock of hair in the context of methods according to the invention.

It is possible, for example, to have a linear or asymptotic variation in the temperature to which the hair composition is subjected according to the position along the lock.

In an alternative form, it is possible to deposit an amount of developer or inhibitor which varies in a linear or asymptotic manner according to the position along the lock.

The application of such gradients can allow shaded hair dyeing or bleaching powers to be obtained, as described in detail subsequently.

Figure 6:
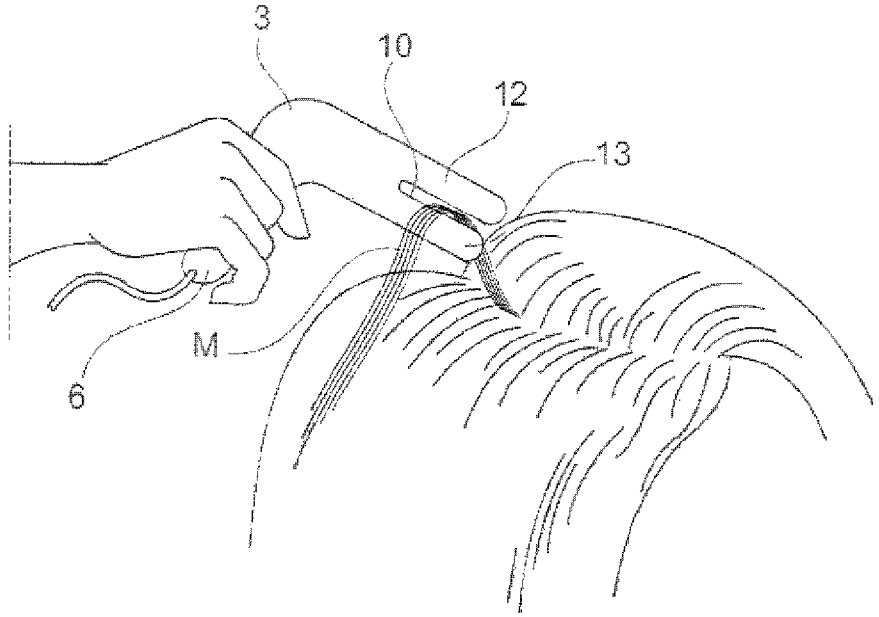
Figure 7:
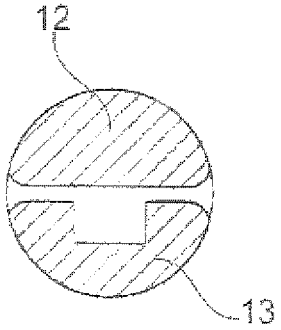
FIGS. 7 to 10 represent diagrammatic and partial transverse cross sections of alternative forms of devices for application of the stimulus in accordance with the invention, FIGS. 11, 12 and 12*a* diagrammatically and partially represent alternative forms of devices for application of the stimulus, FIGS. 13 to 29 diagrammatically and partially represent other implementational examples of methods for producing shaded dyeing or bleaching according to the invention.

In FIG. 6, a composition (not represented) capable of exhibiting a variation in its hair dyeing or bleaching power under the effect of a thermal stimulus has been brought into contact with a lock of hair to be treated M.

The device for application of the stimulus is in the form of a handpiece 3 designed in order to receive the lock M of hair to be treated and in order to subject, in a treatment space, the composition to a stimulus, for example a thermal stimulus.

The handpiece 3 can comprise, as illustrated, a handle 6 and a push button which makes it possible to trigger the emission of the stimulus.

The stimulus, when it is thermal, can be generated, for example, by a series of infrared electroluminescent diodes (not represented).

In the embodiment illustrated in FIG. 6, the stimulus is applied in a non-uniform manner when the handpiece 3 is moved along the lock to be treated M. For example, the power emitted by the electroluminescent diodes increases when the handpiece 3 is moved along the lock to be treated M. The variation can be controlled by the user or can be carried out automatically.

In this case, the position of the handpiece 3 in relation to the treated lock M can be determined by a device (not represented) for the determination of the positioning of the handpiece 3, for example an accelerometer.

The handpiece 3 can exhibit various configurations which make it possible to subject the composition to the stimulus.

The handpiece 3 can comprise any means for receiving and guiding the hair, for example, as is seen in FIG. 6, a channel 10 formed between an upper branch 12 and a lower branch 13 defining the treatment space. The branches 12 and 13 can be fixed in relation to one another or, in an alternative form, be designed so as to part in the manner of a clip, for example, in order to facilitate the insertion between them of the hair to be treated. The closure of the branches can be detected in order to prevent the emission of the stimulus in the case of a defect in closure of the branches.

Figure 11:
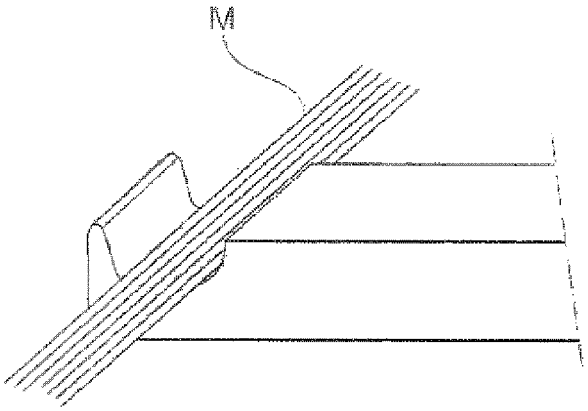

An alternative form of handpiece 3 comprising a channel for receiving the hair to be treated, formed on a single branch, has been represented diagrammatically in FIG. 11.

Figure 8:
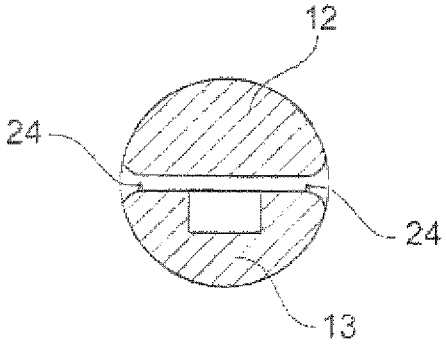

The handpiece can in particular comprise one or more teeth 24 or other protrusions placed before and/or after the treatment space, as has been illustrated diagrammatically in FIG. 8.

The handpiece 3 can comprise means which make it possible to determine the rate of movement of the lock M exposed to the stimulus in relation to the said handpiece. These means can comprise at least one rotary member which rotates under the effect of the movement of the lock M in the treatment space in order to allow the treatment device to automatically calculate, according to this rate of movement, the modification of the stimulus to be applied to the composition.

Figure 9:
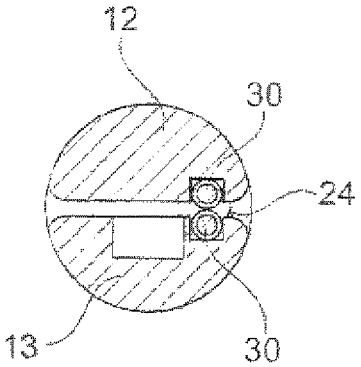

By way of example, a treatment head comprising two opposing rollers 30, which can rotate on contact with the lock M introduced between them, has been represented in FIG. 9.

The rotation of the rollers 30 is measured and the treatment device can comprise calculation means suitable for acting on the emission of the stimulus, for example heat, according to this rotation.

The treatment device can be designed so as to be able to deposit the composition during the movement of the lock M.

Figure 10:
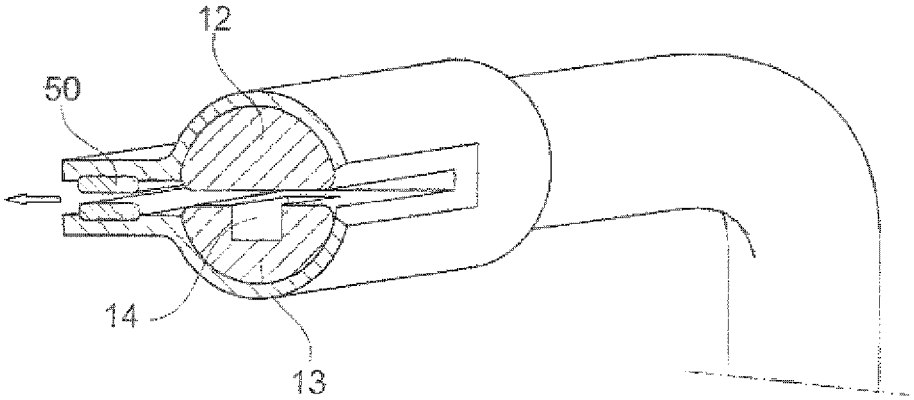

The handpiece 3 can, to this end, comprise an application member 50 comprising, for example, an applicator pad which makes it possible to deposit the composition on the lock M, as illustrated in FIG. 10. This applicator pad is carried by a support which does not interfere with the passage of the lock M between the branches 12 and 13.

The variation in hair dyeing or bleaching power of the composition can be obtained by subjecting to radiation.

For example, the composition can be a photochromic composition which can develop under the effect of radiation having a given wavelength and the shading can be obtained by application of light radiation having an energy spectral density in the vicinity of this wavelength which increases on moving along the lock M.

The device for application of the stimulus can also be produced without a handpiece, for example being provided in the form of a cubicle or of a hood in which the user is placed, the submission to the stimulus being carried out at a distance, it being possible for the hair, if appropriate, to have been prepared beforehand for the treatment, for example placed on an appropriate support.

Screen-forming means can be positioned on either side of the treatment space in order to counteract escapes of light, for example a flexible seal, a row of hairs or a baffle.

Figure 12:
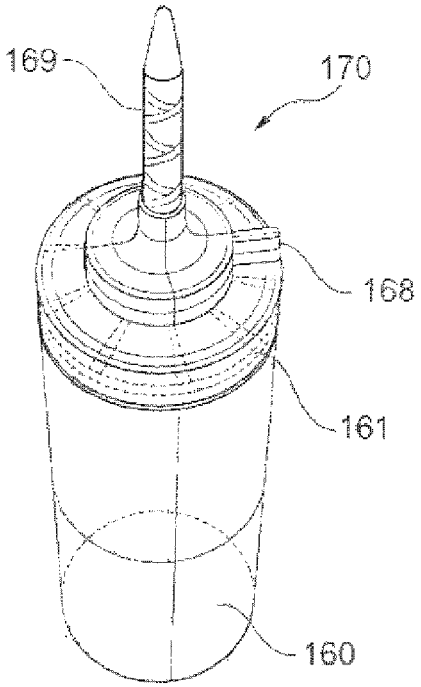

An example of a manual-control device 170, which makes it possible to prepare and dispense a developer, in particular an oxidizing agent, in order to create a deposit of developer having, along the said deposit, a shaded power of developing the composition, has been represented in FIG. 12.

The body 160 defines two reservoirs and the user can apply pressure thereto in order to dispense the contents thereof. A dispensing head 161 provides for the mixing of the contents of the reservoirs in variable proportions. The reservoirs open, for example, through supply orifices 162 and 163 facing an adjusting part comprising two outlet orifices 164 and 165 which can be superimposed more or less on the supply orifices according to the position of this part with respect to the body 160. Thus, for the three relative positions illustrated in FIG. 12A, the components are dispensed respectively in the proportions (expressed in %) of 100/0, 50/50 and 0/100. The part which acts on the flow rate of each of the components may be able to rotate about the longitudinal axis of the device and may, if appropriate, be moved automatically by an elastic return member which cannot be seen and which can be stressed initially by the user by virtue of an operating lever 168. In an alternative form, the operating lever 168 controls the position of the adjusting member and is actuated by the user during the dispensing in order to vary the formulation of the mixture.

In the presence of an elastic return member, a brake, for example of viscoelastic fluid type, can be rotated with the part for adjusting the flow rate so that the movement of the adjusting part under the action of the elastic return member does not occur too quickly.

Figure 12A:
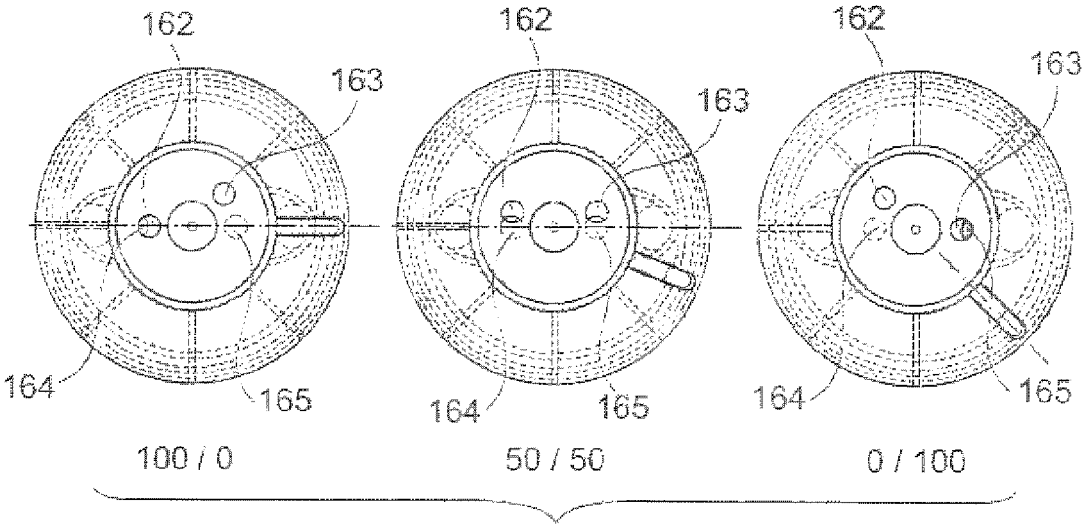

In order to use the system illustrated in FIGS. 12 and 12A, the user actuates the operating lever 168 in order to stress the elastic return member and then releases the operating lever. The adjusting part then moves automatically under the action of the return member for a predefined period of time, during which the user applies pressure to the reservoirs in order to force the products to pass through the dispensing head. In an alternative form, in the absence of an elastic return member, the user moves the operating lever 168 in order to change the formulation.

The formulation of the composition which is dispensed varies, which formulation results from the mixing of the components in a nozzle 169 provided with a mixer, for example having helices having opposite pitches. The user moves the nozzle in relation to the support on which the developer is deposited. He thus obtains a deposit of developer, the power of which to develop the composition varies longitudinally.

Figure 13:
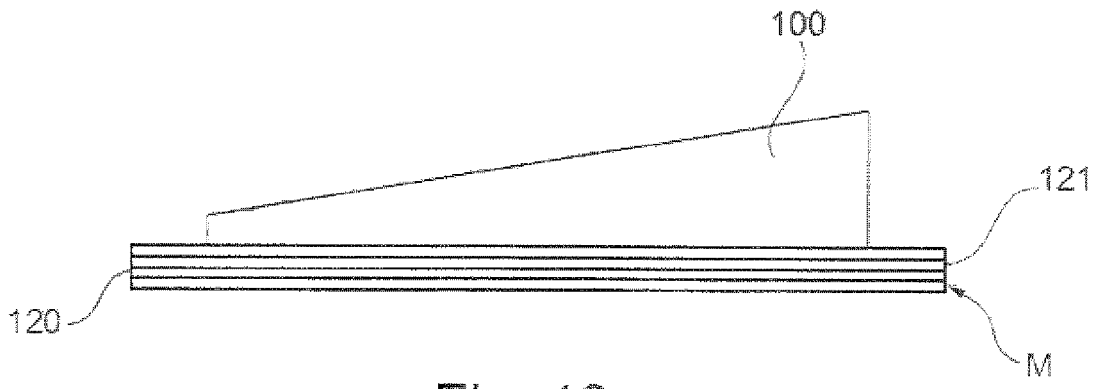
Figure 14:
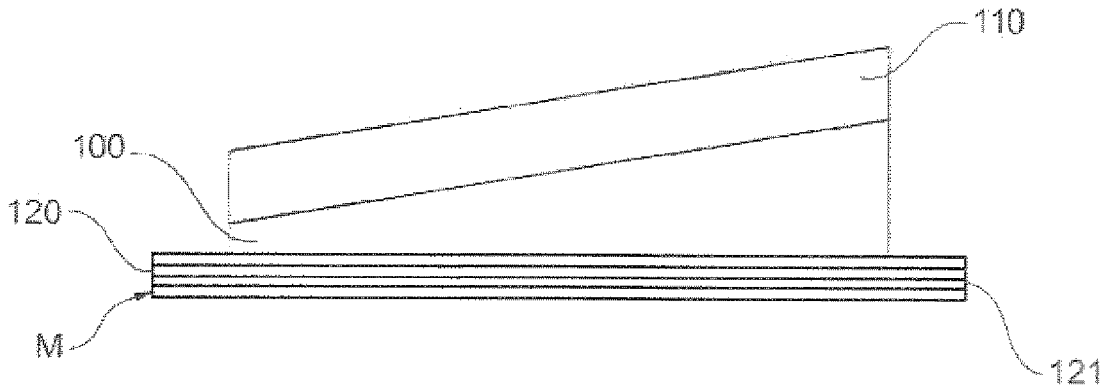
Figure 15:
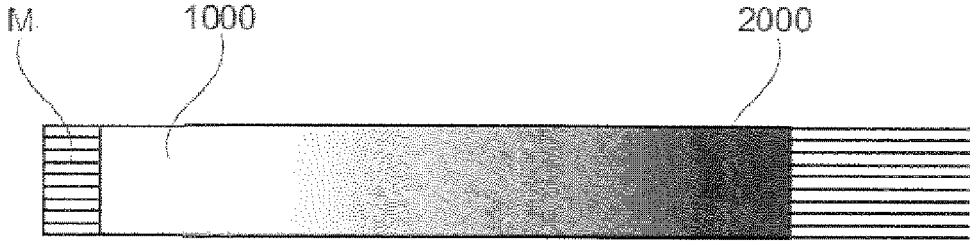

A method for producing a shading on a lock M by bringing the hair into contact with a composition 100 capable of exhibiting a variation in its power to dye hair by being brought into contact with an oxidizing agent 110 has been illustrated in FIGS. 13 to 15.

As represented in FIG. 13, a non-uniform amount of composition 100 has been applied to the lock M, the amount of composition 100 deposited increasing, for example linearly, on moving from the root 120 towards the end 121 of the hairs.

In a second stage, the oxidizing agent 110 is brought into contact with the deposit of composition 100. During this stage, which is illustrated in FIG. 14, the amount of oxidizing agent 110 applied is constant along the treated lock M.

It would be possible to deposit an amount of oxidizing agent 110 which can vary along the lock M. It might also be possible to deposit an amount of composition 100 which is constant along the lock M and an amount of oxidizing agent 110 which can vary along the lock M.

The variable amounts of oxidizing agent 110 or of composition 100 can be deposited along the lock M by transfer from an applicator element or by spraying, the outlet flow rate being modified according to the position along the lock. The variable amount can also be applied by an applicator roller which uses up composition to be applied as it moves along the lock M.

In an alternative form, it is possible to apply a constant amount of composition 100 and a constant amount of oxidizing agent 110 and to vary the exposure time according to the position on the lock M in order to obtain a shaded dyeing or bleaching.

In an alternative form, it is possible to first apply the oxidizing agent 110 to the lock M and to subsequently apply the composition 100. Of course, the embodiments described above apply mutatis mutandis to this alternative form.

FIG. 15 illustrates the production of a shaded dyeing by this method, comprising at least two fractions 1000 and 2000 of composition, each having a different hair dyeing power.

Figure 25:
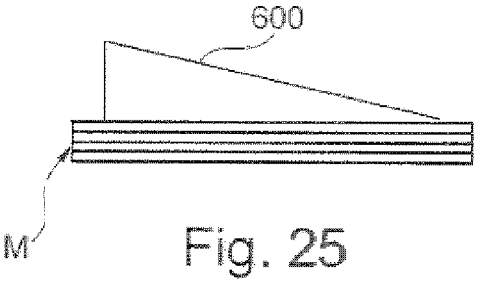
Figure 26:
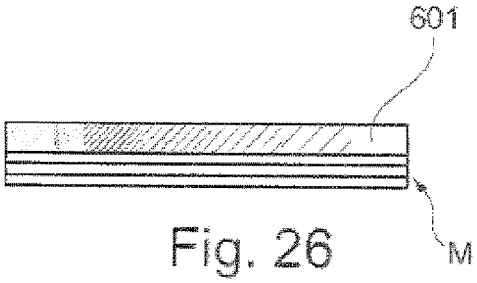
Figure 27:
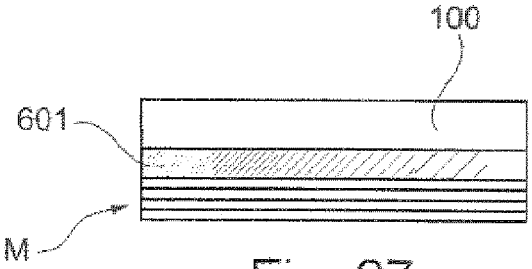

A method for sensitizing shaded hair has been represented in FIGS. 25 to 27. In a first step, as illustrated in FIG. 25, a sensitizing composition 600 is applied to a lock of hair. As illustrated in FIG. 25, the amount of composition 600 deposited varies along the lock M so that the degree of sensitization of the surface 601 of the hair varies along this same direction, as illustrated in FIG. 26. The composition 100 is subsequently applied, as illustrated in FIG. 27, to the sensitized surface 601 in order to obtain the shaded dyeing or bleaching.

Figure 16:
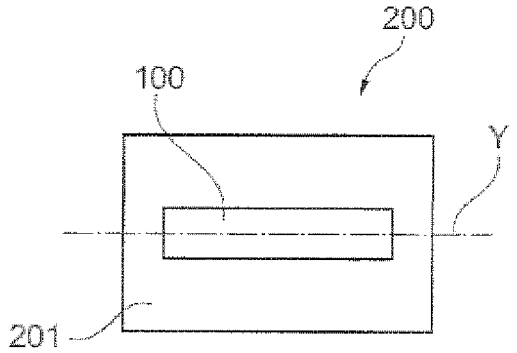
Figure 17:
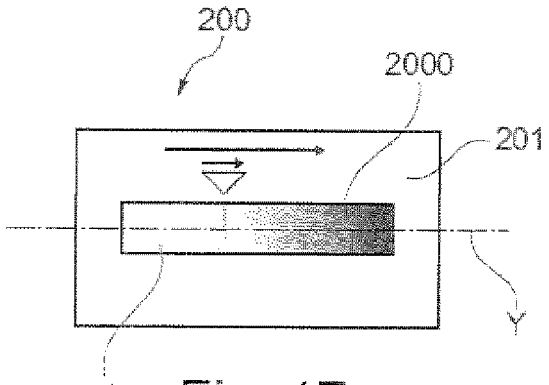

FIGS. 16 and 17 illustrate an application element 200 according to the invention. This application element is, for example, a sheet element.

The application element comprises a transfer surface 201 on which a deposit of composition 100 is present. The deposit of composition 100 extends along a longitudinal axis Y.

Furthermore, the application element 200 comprises heating means (not represented) which make it possible to obtain, at the transfer surface 201, a non-zero temperature gradient along at least one direction.

FIG. 17 represents the state of the deposit of composition 100 after application of the temperature gradient at the transfer surface 201, this temperature gradient making it possible to obtain a first fraction 1000 and a second fraction 2000 of the composition, each exhibiting a different hair dyeing or bleaching power. Preferably, the dyeing and bleaching power varies monotonally along the axis Y.

The composition thus subjected to the temperature gradient can subsequently be applied by transfer to a lock of hair M.

Figure 23:
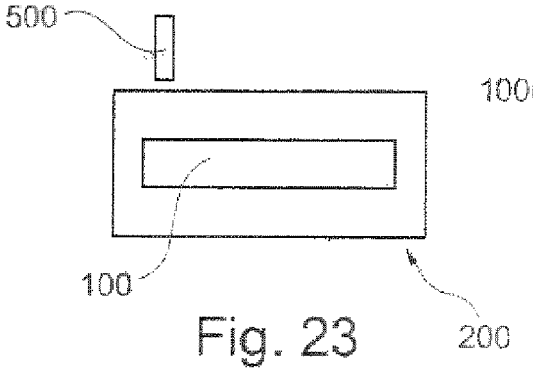
Figure 24:
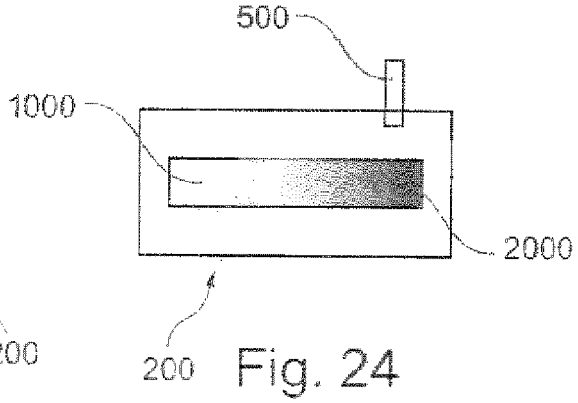

In an alternative form, illustrated in FIGS. 23 and 24, the first fraction 1000 and the second fraction 2000 are obtained by application of a non-zero temperature gradient by an external heating member 500.

In the configuration of FIG. 23, the heating member 500 subjects the composition 100 to a first temperature. The heating member 500 is subsequently moved with respect to the deposit of composition 100 in order to be brought into the position illustrated in FIG. 24, in which it subjects the composition 100 to a second temperature different from the first. In an alternative form, the time of exposure to the heating member, brought to a constant temperature, varies but the duration of positioning at a given location varies, so as to locally heat the composition to a greater or lesser degree, taking into account its thermal inertia.

Figure 18:
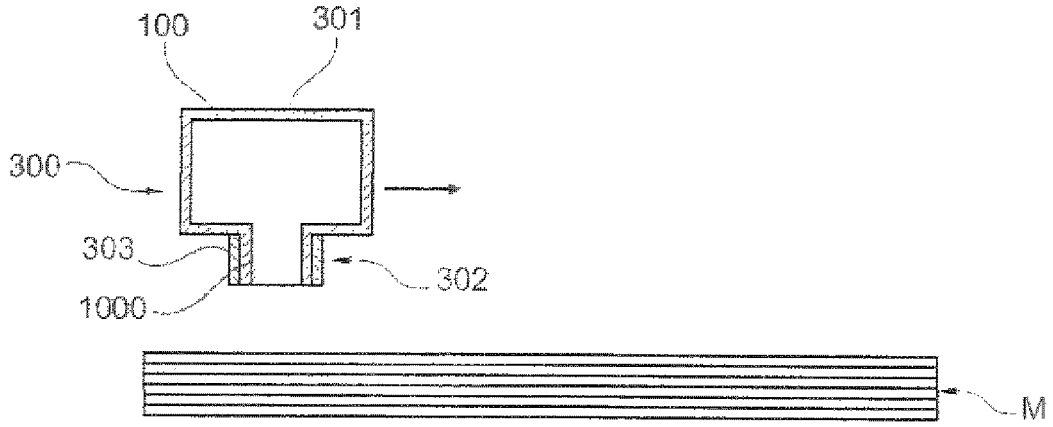
Figure 19:
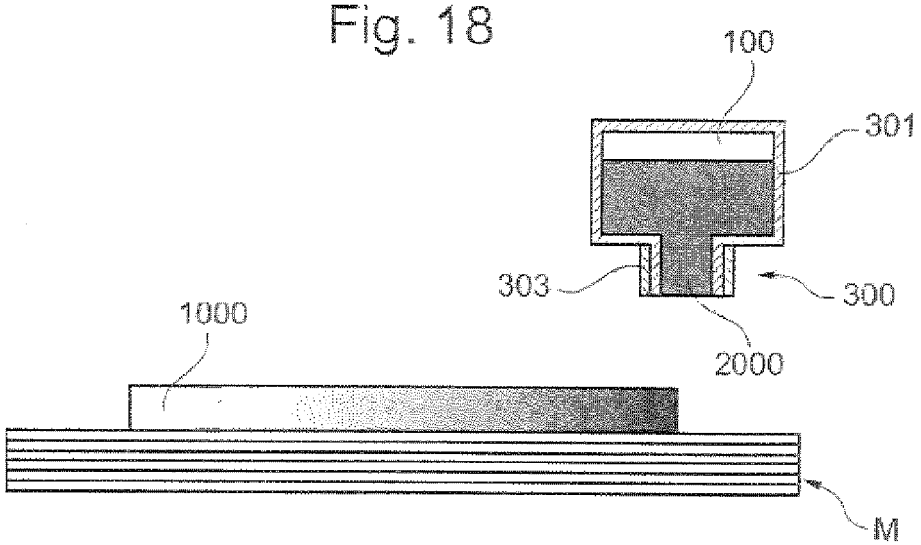

FIGS. 18 and 19 represent an alternative form in which the device 300 for application of the stimulus comprises, within a reservoir delimited by a wall 301, a composition 100 intended to be applied to the hair M.

The device for application of the stimulus comprises an applicator end piece 302 through which the composition 100 is intended to be dispensed onto the lock of hair M.

In the example illustrated in FIG. 18, a heating member 303 is present at the applicator end piece 302.

When the composition 100 is present in the applicator end piece 302, the composition is brought to a first temperature which makes it possible to obtain a first fraction 1000, as represented in FIG. 18. The first fraction is subsequently dispensed on the lock M.

The device 300 for application of the stimulus is subsequently moved in relation to the lock M and can repeat various dispensing operations, the heating member 303 being brought each time to a different temperature.

After several dispensing operations, a deposit is obtained on the lock M which has a hair dyeing power which varies on moving along the lock M. The variation in the temperature preferably takes place continuously.

It is possible, in this implementational example, to replace the heating member 303 with a device which dispenses an oxidizing agent in controlled amounts, the composition 100 exhibiting, in this case, a variation in its dyeing power by being brought into contact with an oxidizing agent.

Figure 20:
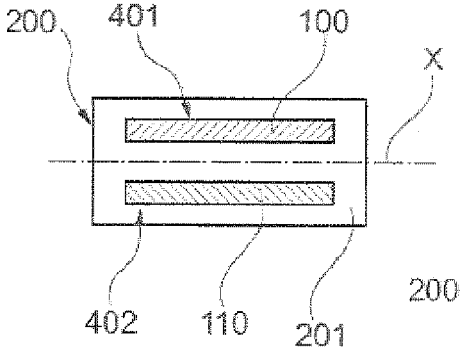

An application element 200 in the form of a sheet element which can be folded back along its axis X has been represented in FIG. 20.

The application element 200 comprises, in a first zone 401, a deposit of composition 100 and, in a second zone 402, a deposit of an oxidizing agent 110.

The amounts of composition 100 and of oxidizing agent 110 can vary or be constant according to the position on the first and second zones 401 and 402 along the longitudinal axis X of the application element 200.

Figure 21:
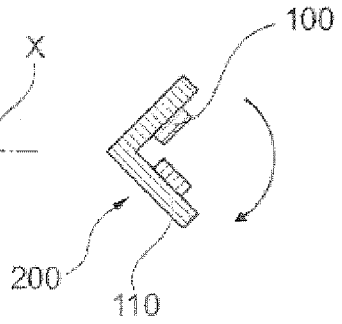
Figure 22:
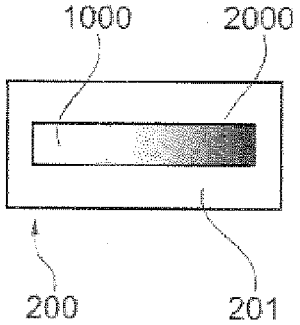

The stage of folding the application element 200 about its axis X, which results in the composition 100 being brought into contact with the oxidizing agent 110, has been represented in FIG. 21. The result of this contacting operation is illustrated in FIG. 22. At least one first fraction 1000 and one second fraction 2000 having different hair colouring powers are obtained.

Figure 30:
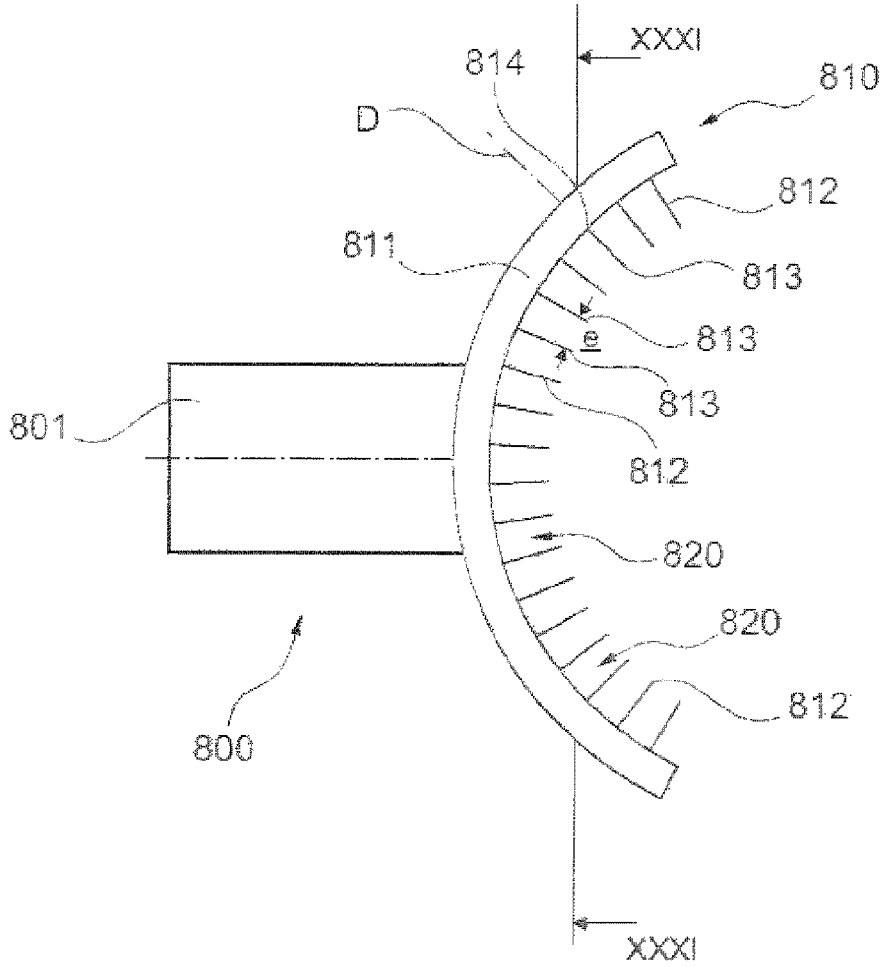
FIG. 30 represents an applicator which makes it possible to simultaneously treat a plurality of locks.

FIG. 30 represents an applicator 800 which makes possible the simultaneous treatment of several locks M of hair. The applicator comprises a support 801, which can in particular constitute a grasping part, connected to a comb 810 comprising a core 811 to which is connected a plurality of teeth 812.

Two consecutive teeth 812 define between them a treatment zone 820 into which all or part of a lock M of hair is intended to be placed in order to receive the hair composition.

The applicator 800 can comprise between 10 and 50 treatment zones 820, in particular between 20 and 40 treatment zones 820.

The arithmetic mean of the spacings e between two consecutive teeth 812 can be between 0.3 cm and 2 cm, preferably between 0.4 cm and 1.5 cm. The spacing e between two consecutive teeth 812 corresponds, as illustrated in FIG. 30, to the length of the segment connecting the distal ends 813 of the said teeth 812.

The applicator 800 can be configured in order to make it possible to obtain a shaded dyeing over a plurality of locks of hair.

Figure 31:
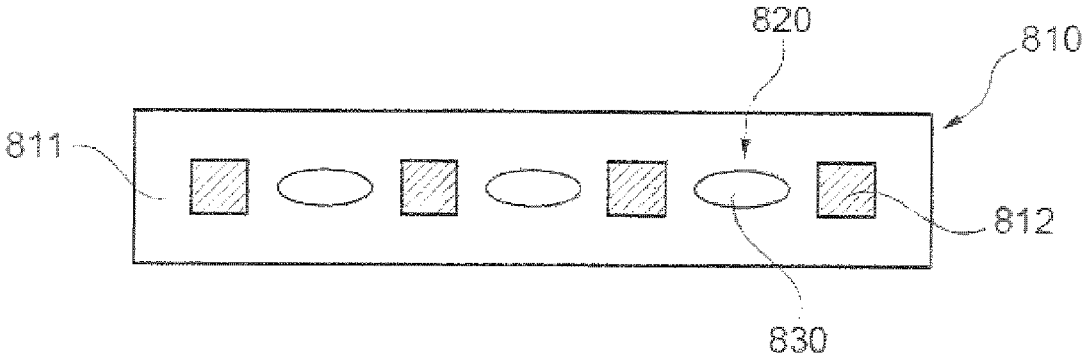
FIG. 31 represents a cross section along XXXI-XXXI of the device of FIG. 30.

The applicator can comprise, as illustrated in FIG. 31, at the treatment spaces 820, orifices 830 for dispensing the hair composition.

The applicator 800 can additionally comprise a plurality of reservoirs (not represented) in which hair compositions having distinct hair colouring powers are present. The applicator 800 can comprise a mixing device (not represented) which makes it possible to mix, in predefined proportions, two hair compositions originating from two different reservoirs. The applicator 800 can additionally be configured in order to apply an energy and/or chemical stimulus as described above.

EXAMPLES

Example of Application of Thermal Stimulus In Situ

Figure 28:
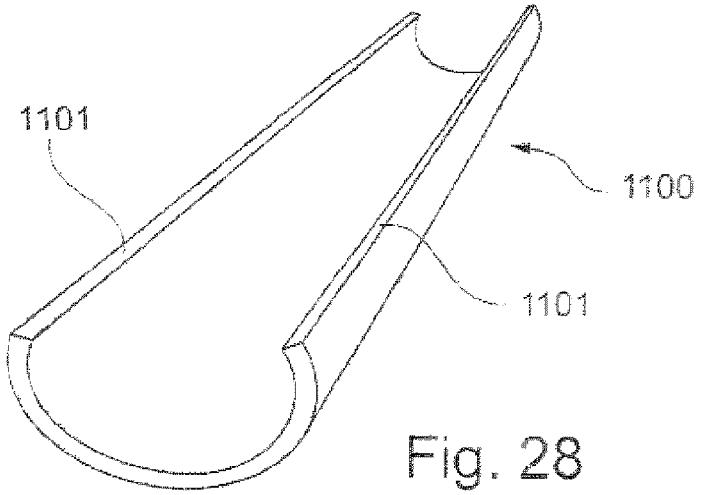

Use is made of a U-shaped tube 1100 with a length of 20 cm and a width of 2 cm, with edges 1101 6 mm in height, as illustrated in FIG. 28.

A solution of PolyNIPAM (poly(N-isopropylacrylamide)) combining two oxidation dye precursors (para-phenylenediamine and resorcinol) is prepared.

The solution is placed at the bottom of the tube and it is left to give a thick gel with a height of approximately 2 mm.

Subsequently, a long lock of grey hair is placed in the tube, in contact with the gel. A 30V oxidant cream is then applied in order to compress the lock in the tube.

A heating device is then positioned, which will impose, on the lower face of the tube, a temperature varying from one end to the other of the length. It varies from 30° C. to 42° C. from one end to the other. After 5 min, the heating device is removed. The lock is left to stand for 30 min. At the end of the treatment, the lock of hair is extricated. The appearance of a shaded dyeing is seen.

Figure 28A:
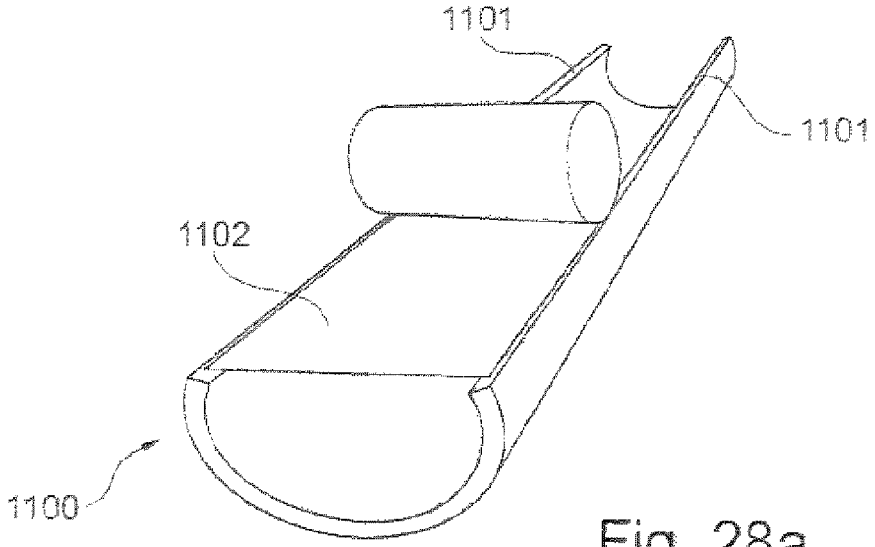

In an alternative form, as illustrated in FIG. 28*a*, a plastic film 1102 can be issued when the desired appearance has been achieved. In this case, the edges 1101 of the tube 1100 can comprise an adhesive deposit which makes it possible to attach the film 1102.

Example of Application of Thermal Stimulus to an Application Element

The same device as in the preceding example is placed, without lock or oxidizing agent, on the heating device. After 5 min, 30V oxidant cream is placed at the bottom of the tube. The lock is then positioned by pushing it into the cream. The lock is left to stand for 30 min. At the end of the treatment, the lock of hair is extricated. The appearance of a shaded dyeing is seen.

Example of Application of a Luminous Stimulus

An ethanolic solution comprising para-phenylenediamine (1%), resorcinol and, for 40% by weight, a composition comprising 10% of p-phenylenediacrylic acid polyester photosensitive polymer (Eastman Kodak) in acetone is placed in a tube as described in the above example.

Its structure corresponds to the following sequence:

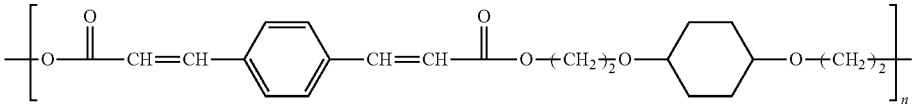

Then, without waiting, the tube is illuminated with an increasing amount of UV-A radiation (360 nm). They UV-A intensity varies from 0 to 5 J per $cm^2$.

Then, without waiting, a white lock is positioned and a creamy composition formed of aqueous hydrogen peroxide solution is positioned. This composition coats the lock and presses it against the bottom of the tube.

After 30 min, the lock is extricated and washed.

A shading in colour is observed over the lock.

Example of Application of a Chemical Stimulus

In this example, use is made of a spray comprising 2% potassium iodide in water.

An ethanol/water (50/50) solution comprising dihydroxyindole and aqueous hydrogen peroxide solution at pH 4 is prepared. A lock of grey hair is impregnated with the abovementioned composition (2 g of solution per 2 g of hair).

Figure 29:
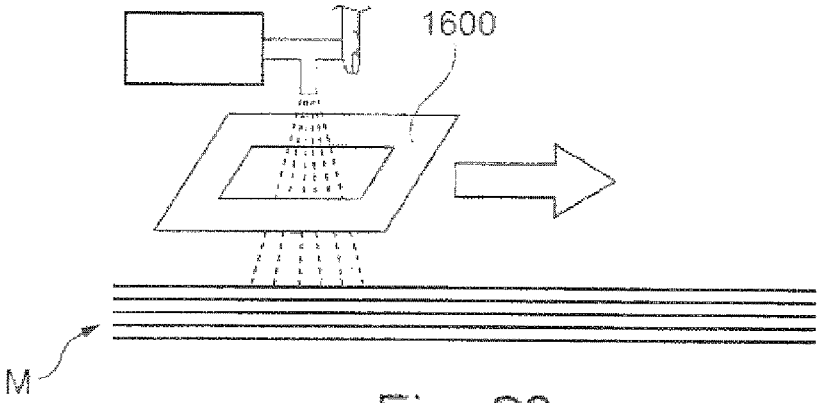

The lock is sprayed from a position 40 cm from the lock. During the spraying, a sheet 1600 formed of board with a hole in it, the hole consisting of a square window of 2 cm by 2 cm, is moved as illustrated in FIG. 29, in order for the sprayed droplets to pass through the window.

The window is moved increasingly rapidly so that one edge of the lock receives, per cm, only 10 mg of sprayed composition, whereas the edge forming the other end receives, per cm, 100 mg of sprayed composition.

At the end of the spraying, the lock is tapped in order for the sprayed liquid to impregnate the lock.

The lock is left to stand for 30 min. At the end of the treatment, the lock of hair is extricated. The appearance of a shaded dyeing is seen.

In an alternative form, first the spraying is carried out (with the moving window), then rinsing is carried out and then the colouring solution is applied.

Alternative embodiments, which are not illustrated, of the invention can combine characteristics originating from the various implementational examples which have just been described.

The expression "comprising a" should be understood to be synonymous with "comprising at least one".

The term "between" should be understood as including the limits.

The invention claimed is:

1. Method for producing a shading on the hair, comprising:

subjecting, to a luminous stimulus, an amount of a dyeing composition capable of exhibiting a variation in its hair dyeing power or hair bleaching power under the effect of the luminous stimulus, the subjection causing at least two fractions of the dyeing composition to respectively have a hair dyeing power or hair bleaching power distinct from the other fraction, wherein the dyeing composition is subjected to the luminous stimulus before being brought into contact with the hair, wherein the dyeing composition, after subjection to the luminous stimulus and being brought into contact with the hair, produces a shaded dyeing or bleaching on the hair, and wherein the luminous stimulus is UV radiation.

2. Method according to claim 1, the at least two fractions being produced by subjecting the dyeing composition to a non-zero temperature gradient.

3. Method according to claim 1, the at least two fractions being produced by subjecting the dyeing composition to radiation exhibiting a non-zero energy gradient.

4. Method according to claim 1, the luminous stimulus being applied by a device for application of the luminous stimulus, wherein the device comprises a luminous irradiator containing the dyeing composition.

5. Method according to claim 4, wherein the device for application of the luminous stimulus provides for the dispensing of the dyeing composition on the hair.

6. Method according to claim 5, the device for application of the luminous stimulus being moved in relation to a deposit of dyeing composition during the application of the stimulus.

7. Method according to claim 1, wherein the dyeing composition is present on an subjection element during application of the luminous stimulus to the dyeing composition.

8. Method according to claim 1, wherein the shaded dyeing or bleaching on the hair obtained comprises a first region and a second region exhibiting between them a colour difference in the CIELab space of greater than or equal to 1.

9. Method according to claim 5, the device for application of the luminous stimulus comprising a system for guiding the hair, the method comprising the successive stages of:

introducing a first lock of hair into the guiding system of the device for application of the luminous stimulus, carrying out a shaded dyeing or bleaching on the first lock of hair by employing a method according to claim 5, optionally applying, over all or part of the shaded dyeing or bleaching carried out on the first lock of hair, a protective means which makes it possible to mechanically protect the shaded dyeing or bleaching, then disengaging the first lock of hair from the guiding system and introducing therein a second lock of hair, carrying out a shaded dyeing or bleaching on the second lock of hair by employing a method according to claim 5.

10. Method according to claim 5, further comprising a stage of determination of the positioning of the device for application of the luminous stimulus in relation to a substrate on which the dyeing composition is applied or may be applied.

11. Method according to claim 10, the substrate being chosen from the hair or the application element.

12. Method according to claim 5, the device subjecting the hair to the luminous stimulus prior to the dispensing thereof or during the dispensing thereof.

13. Method according to claim 6, the deposit of dyeing composition being present in contact with the hair.

14. Method according to claim 7, the application element being in the form of a sheet element.

* * * * *